US007540583B2

(12) United States Patent
Barinaga et al.

(10) Patent No.: US 7,540,583 B2
(45) Date of Patent: Jun. 2, 2009

(54) WIPER

(75) Inventors: John A. Barinaga, Portland, OR (US); Alan Shibata, Camas, WA (US); Tanya V. Burmeister, Vancouver, WA (US); Stephanie Seaman, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 443 days.

(21) Appl. No.: 11/082,093

(22) Filed: Mar. 16, 2005

(65) Prior Publication Data

US 2006/0209122 A1 Sep. 21, 2006

(51) Int. Cl.
*B41J 2/165* (2006.01)
*B41J 2/01* (2006.01)

(52) U.S. Cl. ..... 347/28; 347/22; 347/33; 347/102

(58) Field of Classification Search ..... 347/29, 347/31–33, 12, 22, 28, 35, 43, 100, 102; 101/491

See application file for complete search history.

(56) References Cited

U.S. PATENT DOCUMENTS

| | | | | |
|---|---|---|---|---|
| 4,223,322 | A | 9/1980 | van Raamsdonk | |
| 4,369,456 | A | 1/1983 | Cruz-Uribe et al. | |
| 4,450,456 | A | 5/1984 | Jekel et al. | |
| 4,928,120 | A | 5/1990 | Spehrley, Jr. et al. | |
| 5,051,761 | A * | 9/1991 | Fisher et al. | 347/30 |
| 5,757,387 | A | 5/1998 | Manduley | |
| 6,375,302 | B1 * | 4/2002 | Medin | 347/28 |
| 6,428,159 | B1 * | 8/2002 | Roy et al. | 347/102 |
| 6,695,429 | B2 | 2/2004 | Barinaga | |
| 6,957,881 | B2 * | 10/2005 | Nishino | 347/33 |
| 2003/0081043 | A1 * | 5/2003 | Klausbruckner et al. | 347/22 |
| 2004/0080563 | A1 * | 4/2004 | Leemhuis | 347/22 |

* cited by examiner

*Primary Examiner*—Stephen D Meier
*Assistant Examiner*—Alexander C Witkowski

(57) ABSTRACT

A printer includes an arcuate arrangement of printheads and a retractable arcuate arrangement of wipers.

33 Claims, 5 Drawing Sheets

WIPER

BACKGROUND

Devices that deposit liquids, such as, for example, ink, may at times be serviced. An example of such a device may include, without limitation, a printer. This may be due at least in part to normal wear and tear from repeated use. Thus, such devices may include systems to provide servicing.

DETAILED DESCRIPTION

Figure 1:
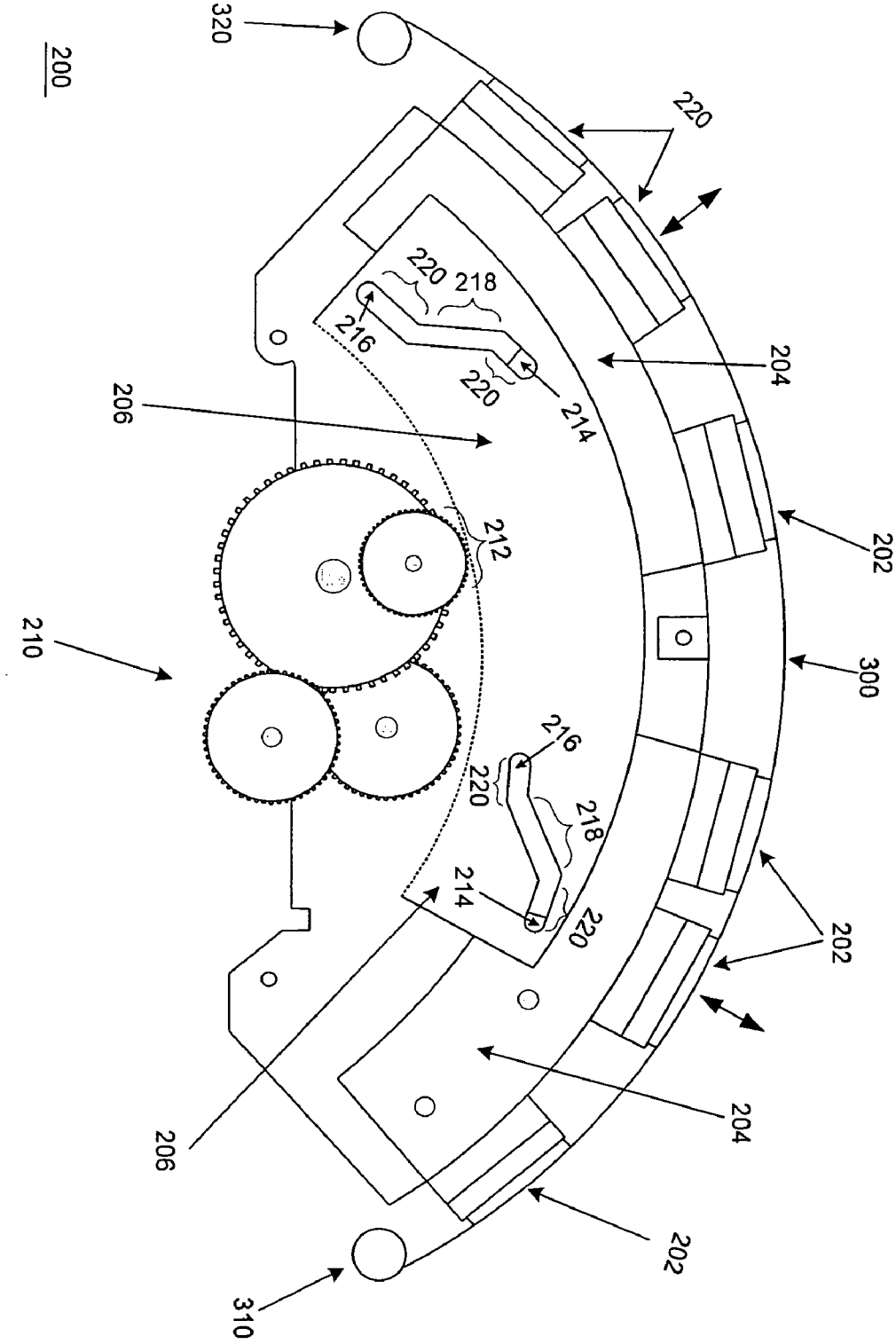
FIG. 1 is a schematic diagram illustrating an embodiment of a wiper.

The following detailed description presents illustrative embodiments consistent with claimed subject matter. This description is not meant to be taken in a limiting sense, but rather to serve the purpose of illustrating general principles consistent with claimed subject matter. In some instances, detailed discussions of various operating components are omitted so as not to obscure claimed subject matter. The term image-forming device or apparatus as used in this application is meant to have a broad interpretation and include devices such as printers, copiers, scanners, facsimile machines, and/or other devices capable of producing output images which may include alphanumeric characters, graphical, pictorial, textual, and/or other image types. Likewise, the term printer in this context is intended to include any device that includes the capability to print.

In some embodiments, a device may perform, at least in part, maintenance operations, such as on printheads in a drum-based image forming device or the like. At least in part because printheads may be arranged radially around the drum in a drum-based image forming device, in one such embodiment, one or more wipers may move radially with respect to the drum. In this context, radially generally refers to movement along or substantially along a radius or radii of a curved structure, such as, for example, and without limitation, a drum. For example, a wiper may move radially away from the drum so as to at least partially contact a corresponding printhead. Likewise, a wiper may move from a radially extended position to a retracted position. Although claimed subject matter is not limited in scope in this respect or to this particular embodiment. Thus, for this particular embodiment of a drum-based image forming device or apparatus, a printer, for example, may include wipers arranged in an arc shaped or arcuate configuration around a drum so as to engage or at least particular contact printheads arranged in a similar configuration around the drum. In this context, the term printhead refers to a component of an image forming device or apparatus, such as a printer, for example, that is designed or constructed so that, during operation of the device or apparatus, a media, such as, for example, paper, receives via the printhead a substance, such as ink, so as to form an image on the media. Likewise, for this particular embodiment, it is appreciated that particular printheads and wipers may be correspondingly positioned so that a particular wiper may service a particular printhead, for example. As suggested previously, the term image is used here in a general sense to include characters, text and/or a variety of other image types in addition to graphical and/or pictorial images.

Likewise, a mechanism may be provided for moving the wipers radially in and out of engagement with one or more of the printheads. For example, wipers may be lifted, deployed, extended, retracted, and/or otherwise moved between a first position for compact storage, such as if not being used, and a second position, such as to engage or at least partially contact the printheads. The wipers may be formed of rubber or another elastomeric substance so as to be generally compliant (e.g., accommodating or spongy) for substantially conforming to the surface being wiped, although claimed subject matter is not limited in scope in there respect. The wipers may also be designed for multidirectional compliance or operation so as to scrape printheads passing into and out of contact with the wipers from one or more directions. The wipers may be extended in an arc configuration sized and shaped to correspond to the arc of the printheads. Deploying the wipers in an arc to substantially match the arc of the printheads may allow for effective, substantially contemporaneous cleaning of multiple or all of the printheads. However, again, claimed subject matter is not limited in scope to possessing the foregoing features.

In an additional or alternative embodiment, a web wipe material may be provided, for example, to remove waste deposits. In such embodiments, a web wipe system using a web material may be indexed between two or more spools. The web material may be positioned between the wipers and the printheads. This configuration may allow the wipers to bring the web material into contact with the printheads in an arc shaped configuration that substantially corresponds to the arc of the printheads, although claimed subject matter is not limited in scope in this respect. Appropriate tensioning may be applied to the web material to maintain the web material sufficiently taut during extended or retracted positioning. Indexing, or advancing, the web material between cleanings or at other intervals may provide clean web material for wiping the printheads. It is, of course, noted that these are particular embodiments and claimed subject matter is not limited in scope to these particular embodiments. Many more embodiments with a host of variations and/or changes are possible and are included within the scope of claimed subject matter.

A wide variety of drum-based image-forming devices have the potential to include one or more printheads. These may include copiers, printers, facsimile machines, and/or other devices that form images on a substrate media with liquid ink or other imaging fluid. For simplicity, and for illustrative purposes without limitation, the following disclosure will focus primarily on printers, such as bubble jet and/or ink jet printers. However, references throughout this disclosure and in the appended claims to printer devices, or components, such as printer pens, printheads, print drum and/or the like are also meant to encompass other, non-printer types of image-forming devices and/or their relative components. Likewise, the scope of claimed subject matter is not limited to servicing printheads for printers. Those skilled in the relevant art will readily appreciate that other physical embodiments are also within the scope of claimed subject matter.

In one type of drum-based printer, print media may be carried by a cylindrical drum rotating past a printhead assembly or array that translates back and forth over the drum. In some embodiments, the printhead assembly is stationary during printing. Ink may be deposited by printheads onto print media to create an image. An alternative configuration may have ink deposited by printheads onto a rotating drum, and then transferred from the rotating drum to the print media. With either of these embodiments, printheads may be positioned in an arc around the print drum for depositing ink, although, again, claimed subject matter is not limited in scope in this respect.

Image or print quality may depend at least in part on care and/or maintenance of the printheads. Accordingly, printers and/or other image-forming devices using printheads typically may include one or more wipers. Illustrative embodiments may be understood more readily with reference to the accompanying drawing figures as set out below.

Figure 2:
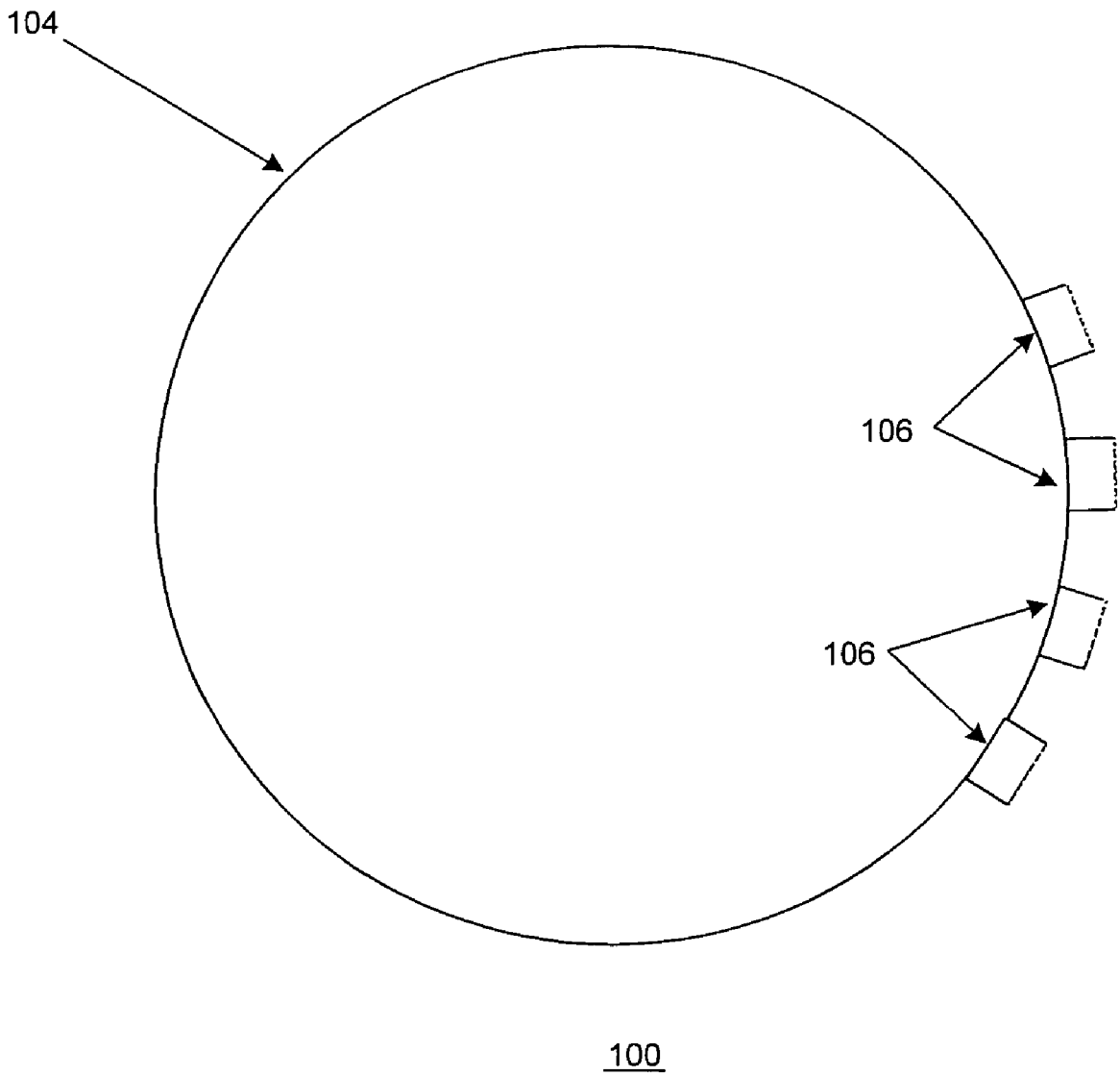
FIG. 2 is a schematic diagram illustrating an embodiment of a printer that includes an embodiment of a print drum and an embodiment of one or more printheads.

With particular reference to the drawing figures, FIG. 2 is a schematic diagram illustrating an embodiment 100 of a portion of a drum-based printer. Printer 100 includes a print drum 104. Print drum 104 is situated under printheads 106 provided on one or more printer pens 108 (FIG. 3), which may be arranged in a substantially arc-shaped configuration or array around at least a portion of print drum 104, as illustrated. During printing operation, printer pens 108 translate along print drum 104, in some embodiments. In other embodiments, printer pens 108 remain stationary during printing, but move after printing for servicing. Ink may then be deposited through nozzles within printheads 106. The ink may be deposited from printheads 106 onto the target medium or media, which may be carried on print drum 104 under printheads 106 to receive ink. Alternatively, ink from printheads 106 may be deposited on an intermediate media, such as drum 104, which may subsequently transfer ink to the target media.

Figure 3:
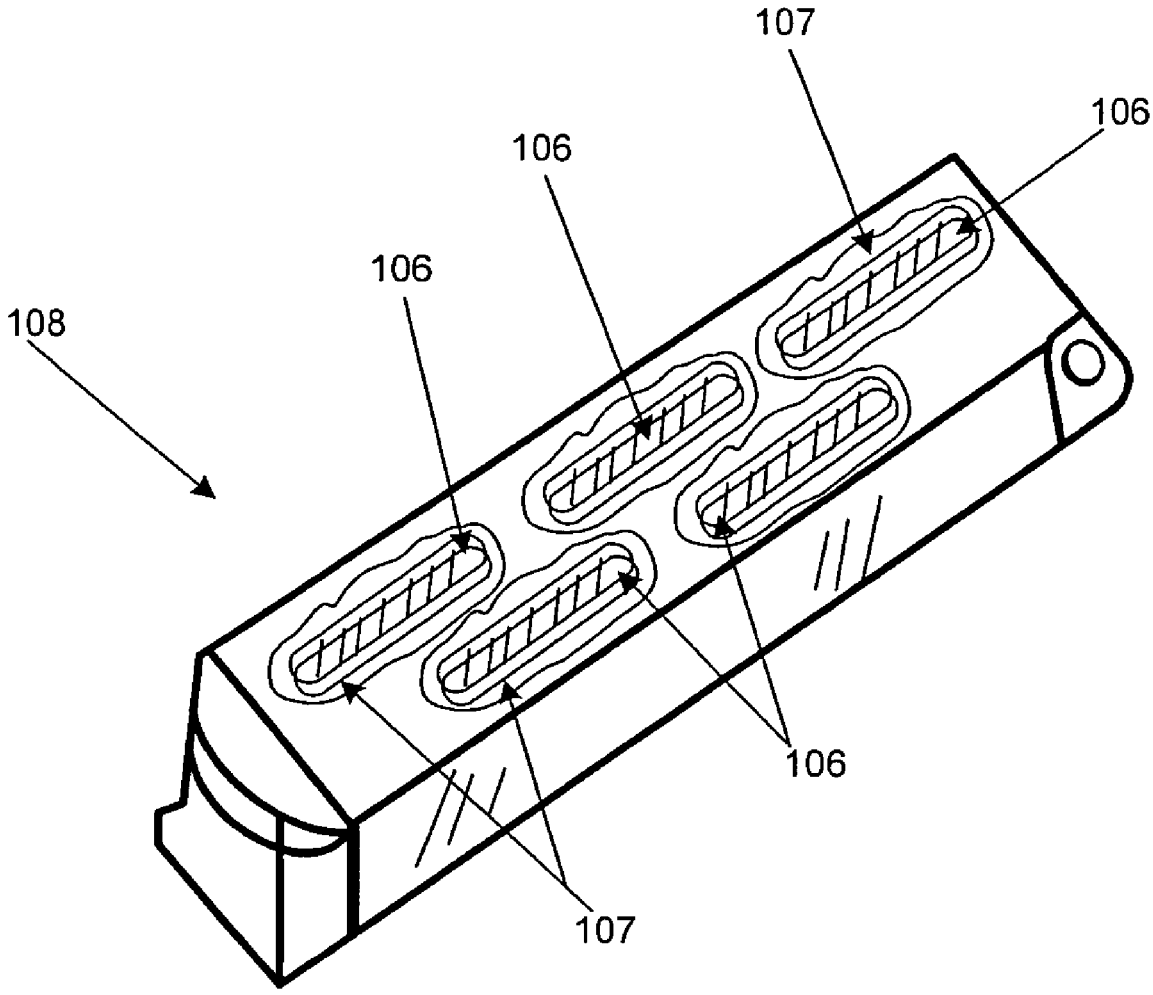
FIG. 3 is a schematic diagram illustrating an embodiment of a pen.

FIG. 3 illustrates one configuration of a printer pen 108 having a plurality of printheads 106. Although FIG. 3 illustrates an embodiment of a printer pen having five printheads 106, those skilled in the art will readily appreciate that numerous alternative configurations may be employed based at least in part on potential functionality. For example, a printer pen could be provided with a single printhead. FIG. 3 also illustrates waste material 107, such as excess ink, that may accumulate on printer pen 108 in the vicinity of printheads 106.

Figure 4:
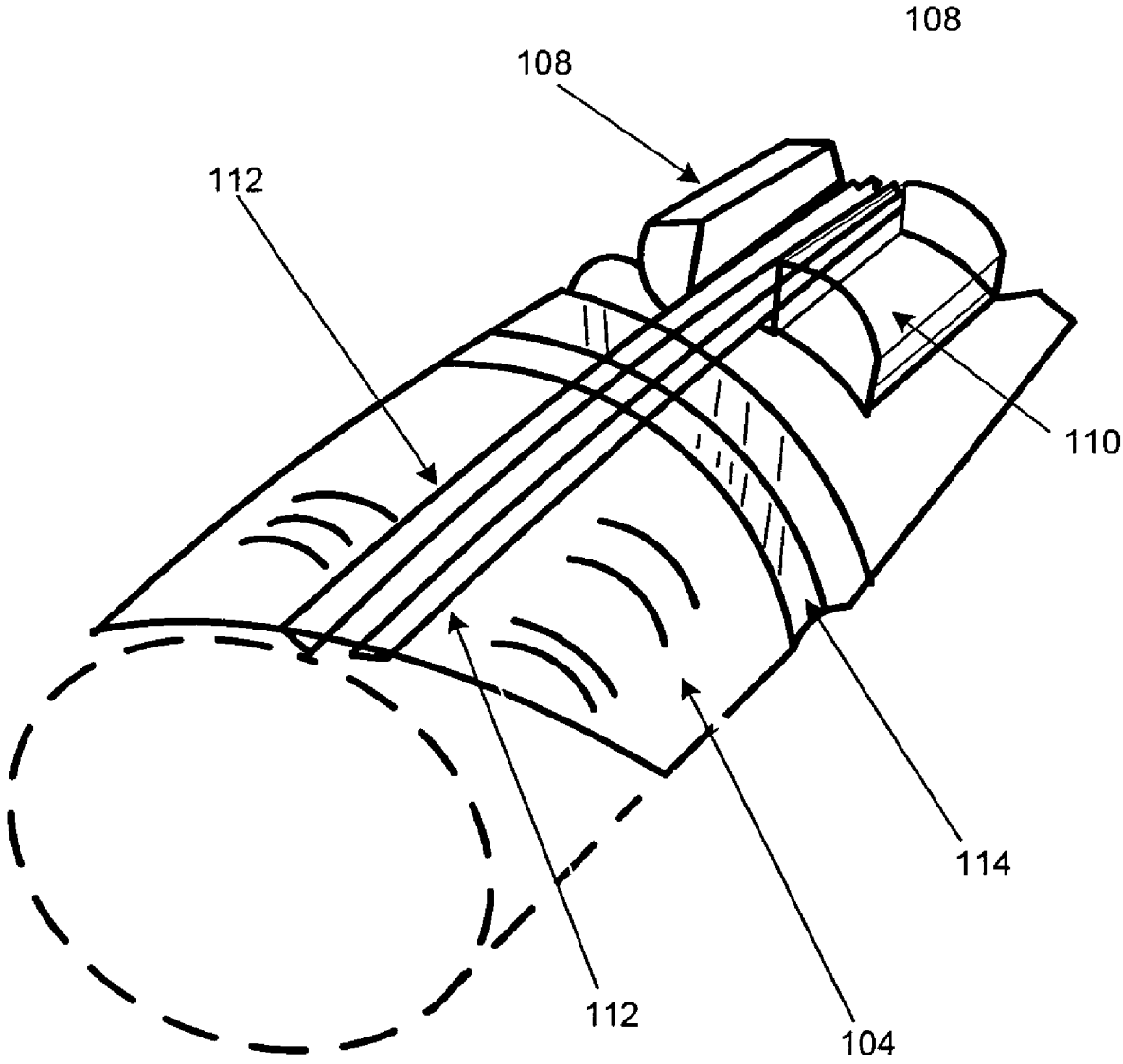
FIG. 4 is a schematic diagram of the embodiment of FIG. 2 with the addition of an embodiment of a carriage.

FIG. 4 illustrates a drum-based printer embodiment 100 of FIG. 2 in perspective view and additionally including an embodiment of a carriage 110 for holding printer pens 108 (not shown) and printheads 106 (not shown) in place in an arc corresponding to print drum 104. Carriage 110 is supported by one or more tracks 112 which serve as support and/or guide rails to allow carriage 110 to translate printheads 106 over print drum 104. As discussed in more detail below, carriage 110 may also move printheads 106 into position for cleaning or other maintenance operations, such as at a service station 114. Carriage 110 may move printheads to a position to be serviced by one or more wipers provided in service station 114, in this particular embodiment. As shown in FIG. 4, one possible placement of service station 114 may be at a substantially axial end of print drum 104. However, claimed subject matter is not limited in scope in this respect.

In one embodiment, service station 114 may include one or more wipers arranged to scrape or wipe away waste material 107 accumulated on printheads 106. Drum-based printers in accordance with some embodiments of claimed subject matter may have printheads arranged in a substantially arc-shaped configuration or array; thus, wipers for cleaning the printheads are configured to substantially engage or at least partially contact the printheads in a substantially similar arc-shaped configuration, in some embodiments. Embodiments may also include a mechanism to place wipers into position to wipe the printheads, and retract the wipers to a storage position when they are not being used. However, claimed subject matter is not limited in scope to this embodiment.

FIG. 1 depicts one illustrative embodiment of a wiper, including a mechanism 200. FIG. 1 includes six wipers 202. The actual number of wipers may be varied, of course. Additional or fewer wipers may be included depending at least in part, for example, on the intended application of the service station, the printer pens, printheads, their placement and/or a host of other factors. In one embodiment, it may be satisfactory to provide one or more wipers for each printer pen, although claimed subject matter is not limited in scope in this respect. This may, for example, allow several or all pens to be cleaned by a plurality of wipers in a substantially simultaneous manner, although claimed subject matter is not limit in scope in this respect.

FIG. 1 illustrates wipers 202 deployed in an extended position. As previously indicated, wipers 202 may be made of rubber or other suitable substances. While those skilled in the art will appreciate that many additional or alternative configurations of mechanisms could be used, the system of FIG. 1 illustrates a mechanism using a lift cam to raise and lower the wipers in a substantially radial direction.

Figure 5:
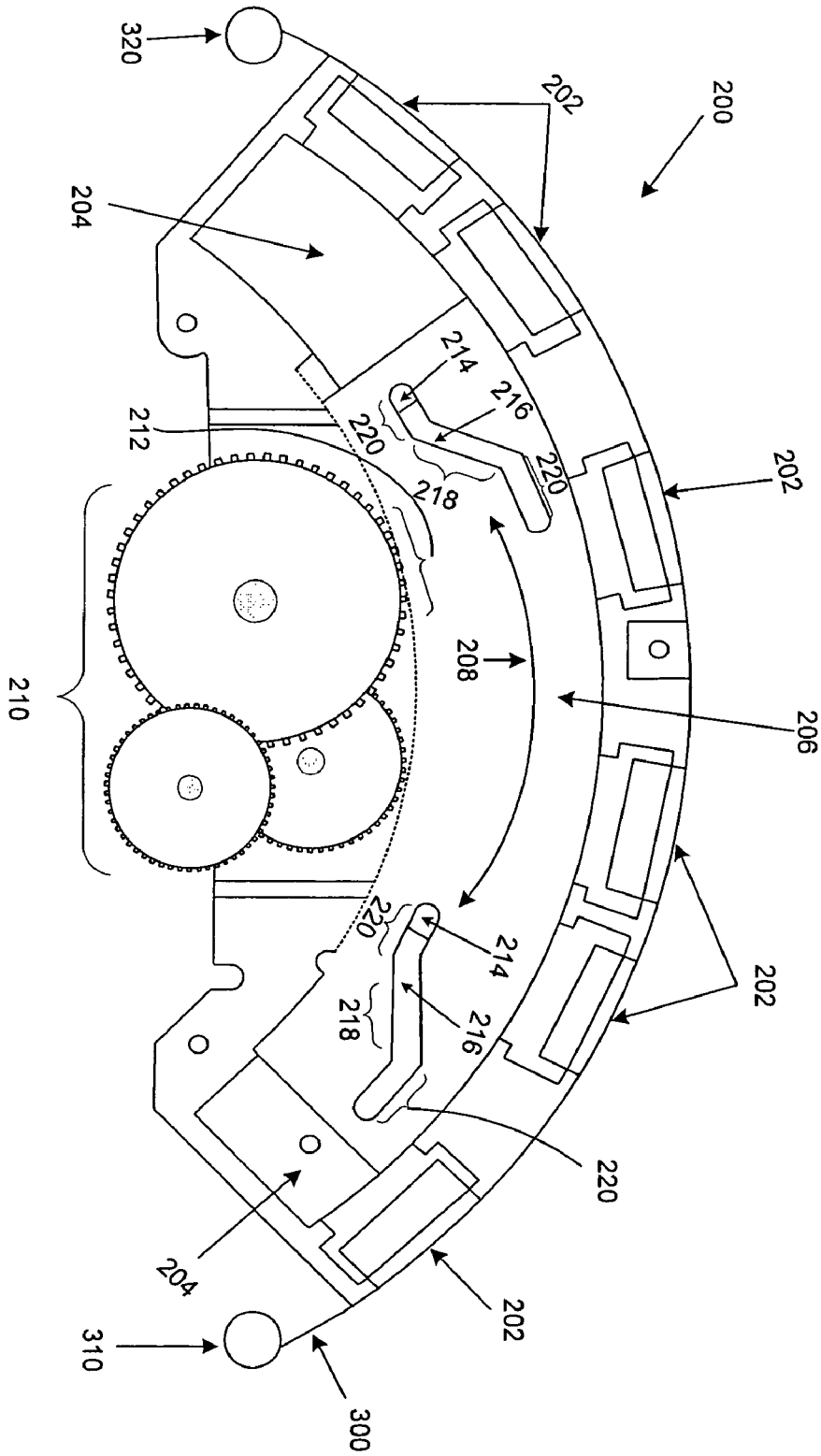
FIG. 5 illustrates the embodiment of FIG. 1 with the embodiment of the wiper retracted.

Referring to FIG. 5, for this embodiment, wipers 202 included in mechanism 200 are distributed among two wiper shuttles 204 (three wipers 202 to a shuttle 204 as illustrated). The shuttles may move in a substantially radial direction depending at least in part on the position of a lift cam 206, which may rotate around the center of the drum in a guide slot (conceptually depicted by arrow 208). The position of lift cam 206 may be controlled by a drive motor, which has a corresponding gear train 210 in this embodiment. The bottom surface of the lift cam may be fitted with gear teeth 212 that mesh or couple with the gears in drive transmission 210. Shuttles 204 may also be fitted with a post 214 that may ride in one or more positioning slots 216 in lift cam 206.

The angular position of lift cam 206 may determine the radial position of wiper shuttles 204 at least in part. Positioning slots 216 in lift cam 206 may be configured with ramps and/or flat portions for positioning and/or maintaining wipers 202 in an extended or retracted position. Ramp 218 portion of positioning slots 216 may move the shuttles inward and outward, depending at least in part on the direction in which lift cam 206 is traveling. Flat portions 220 of positioning slots 216 may maintain the radial position of the shuttles. Providing flat portions 220 within positioning slots 216 may allow lift mechanism 200 to hold the shuttles in place, although claimed subject matter is not limited in scope in this respect.

FIG. 5 shows mechanism 200 of FIG. 5 with wipers 202 in a retracted position. Correspondingly, lift cam 206 is illustrated in a second position having been rotated angularly in guide slot 216 by the gears of drive mechanism 210 to retract wiper shuttles 204. Wiper shuttles 202 are repositioned by the channeling of shuttle posts 214 through lift cam positioning slots 216. As lift cam 206 is moved by drive mechanism 210, shuttle posts 214 in repositioning slot 216 move from one flat portion 220 of repositioning slot 216 through ramped section 218 and into second flat portion 220. Wipers 202 are fixed to shuttles 204, and the position of shuttles 204 is governed by the position of shuttle post 214 in positioning slot 216, so the movement of the lift cam may result in a corresponding movement in wipers 202. In other embodiments, the wipers may be raised and lowered by structures other than cams. For example, the wipers, in some embodiments, may be raised and lowered under the influence of one or more solenoids.

Embodiments of claimed subject matter also enable the use of an indexing web wipe system. In one embodiment, the web wipe system may include a web of absorbent fabric indexed between two or more spools, as previously suggested, such as spools 310 and 320 of FIG. 1, for example. The web may be indexed, or advanced, when the wipers are in the retracted position, thus clean web material may be brought into position for subsequent wiping. The web material may be positioned substantially proximate to the wipers, and extension of the wipers may bias, or press, the web material against the printheads.

FIG. 1, discussed previously, also illustrates one embodiment of a spooled, indexing web wipe material used in conjunction with an embodiment of the previously described wipers. This system thus may use the web wipe material to clean the printheads. The web wipe of FIG. 1 includes a web material 300, made of absorbent fabric in this embodiment. Wipers 202 may apply a biasing force to substantially conform the web material into an extended, or radially outward, position, and then the printheads may be dragged, or otherwise advanced, across the fabric, such as with motion of printhead carriage 110, allowing the web material to absorb ink residue from the printheads. In an additional or alternative embodiment, the wipers may be configured to extend a first subset of the wipers at least slightly before extending a second subset of the wipers. Such a configuration may allow the wipers to engage the web wipe in a substantially non-contemporaneous manner, for example.

Web material 300 may be provided in a cartridge so that replacement of web material may be accomplished easily. The web material may be indexed from a first spool to a second. A stepper motor or other drive mechanism may be provided, along with one or more drive gears to advance, retract, and/or tension the web. Appropriate tensioning may be applied to the web material to maintain the web material sufficiently taut during extended or retracted positioning. Indexing the web material between cleanings or at other desirable intervals may repeatedly provision clean web material for subsequent cleanings of the printheads. When the web material has been used up, the old cartridge may be replaced with a new cartridge of clean web material.

FIG. 5 depicts wipers 202 in a retracted position, as previously discussed. Web material 300 may also be moved into a retraced position. With wipers 202 and web material 300 out of the way and retracted into a compact storage position, the printheads may pass over the wiping system without contacting the web material or wipers.

Relative motion of the printheads and web material to accomplish cleaning may also take place though action of the carriage. Once the web material and wipers are placed in the path of the printheads, the printheads may be translated and brought into contact across the web material or wipers. After the printheads are cleaned, the wipers and web material may be retracted in place.

Additional cleaning and/or maintenance operations may be provided by a service station and remain within the scope of the claimed subject matter. It will be apparent to those having skill in the art that many changes may be made to the details of the above-described embodiments without departing from the underlying principles of claimed subject matter; however, the scope of claimed subject matter should be determined with reference to the following claims.

The invention claimed is:

1. A printer, comprising:

a print drum having a circumferential surface about a first axis;

a plurality of arcuately arranged print heads about the first axis;

a first plurality of wipers arcuately spaced around the first axis along the circumferential surface, all of the first plurality of wipers configured to be concurrently moved in unison towards the circumferential surface to print head servicing positions in which all of the first plurality of wipers are concurrently positioned to apply force to one or more of the print heads without further movement of the wipers; and a lift cam and drive mechanism configured to move the first plurality of wipers in unison towards or away from the circumferential surface.

2. The printer of claim 1, and further comprising a web material positioned so that extension of the first plurality of wipers results in the first plurality of wipers at least partially contacting said web material.

3. The printer of claim 2, wherein said web material comprises a fabric.

4. The printer of claim 3, wherein said fabric exhibits absorbent properties.

5. The printer of claim 2, and further comprising:

a plurality of arcuately arranged print heads; and a carriage to move the plurality of arcuately arranged print heads along the first axis.

6. The printer of claim 1, wherein each of the first plurality of wipers has a longer dimension-longitudinal second axis substantially tangential to the circumferential surface.

7. The printer of claim 1, wherein each of the first plurality of wipers has a longer dimension-longitudinal second axis extending in a plane substantially perpendicular to the first axis.

8. The printer of claim 1, wherein the first plurality of wipers includes a first wiper at a first arcuate position, a second wiper at a second arcuate positioned arcuately spaced from the first wiper and a third wiper at a third arcuate position arcuately spaced from the second wiper.

9. The printer of claim 1, wherein the lift cam is configured to rotate about a center of the print drum.

10. The printer of claim 1 further comprising:

a second plurality of wipers arcuately spaced around the axis along the circumferential surface;

a first shuttle carrying the first plurality of wipers; and a second shuttle carrying the second plurality of wipers.

11. An apparatus, comprising:

wipers arranged in an arcuate configuration;

a wiper mechanism to move said wipers radially; and an arcuate arrangement of print heads capable of being positioned correspondingly to said wipers, the print heads including a first print head, a second print head and a third print head, wherein the wipers include a first wiper opposite the first print head, a second wiper opposite the second print head and a third wiper opposite the third print head.

12. The apparatus of claim 11, and further comprising a web material extending across a plurality of the arcuately arranged wipers.

13. The apparatus of claim 12, wherein said web material is configured to index between a plurality of spools.

14. The apparatus of claim 11 further comprising a web material extending across a plurality of the arcuately arranged wipers, wherein said print heads are further capable of at least partially contacting said web material if said wipers are extended.

15. The apparatus of claim 11 further comprising print heads configured to be moved in a direction along an axis of the arcuate configuration across the wipers during wiping of the print heads.

16. The apparatus of claim 11, wherein all of the wipers are configured to be concurrently moved in substantial unison with one another towards the circumferential surface to print head servicing positions in which all of the wipers are concurrently positioned to apply force to one or more of the print heads without further movement of the wipers.

17. The apparatus of claim 11, wherein the wipers are arranged in the arcuate configuration about a first axis and wherein each of the wipers has a longer dimension-longitudinal second axis extending in a plane substantially perpendicular to the first axis.

18. The apparatus of claim 11 further comprising a print drum configured transport print media, wherein the wiper mechanism includes a lift cam configured to rotate about a center of the print drum.

19. The apparatus of claim 11, wherein the wipers include a first plurality of wipers and a second plurality of wipers and wherein the wiper mechanism includes:

a first shuttle carrying the first plurality of wipers; and a second shuttle carrying the second plurality of wipers.

20. An image-forming system, comprising:

a drum; and radially movable arcuately arranged wipers; and a web material extending in an arc across a plurality of the arcuately arranged wipers.

21. The system of claim 20, and further comprising print heads positioned at least partially around said drum.

22. The system of claim 20, wherein said web material includes a strip of absorbent fabric.

23. The system of claim 20 further comprising print heads capable being positioned at least partially around of the drum, wherein all of the wipers are configured to be concurrently moved in unison with one another towards a circumferential surface of the drum to print head servicing positions in which all of the first plurality of wipers are concurrently positioned to apply force to one or more of the print heads without further movement of the wipers.

24. A printer system, comprising:

means for wiping one or more of a plurality of arcuately arranged print heads; and means for radially extending and retracting said means for wiping, wherein said means for radially extending and retracting comprises a lift cam and drive mechanism.

25. The printer system of claim 24, and further comprising means to absorb liquid waste material.

26. The printer system of claim 25, wherein said means to absorb comprises a fabric material.

27. The printer system of claim 24, wherein said means for wiping comprises a plurality of arranged wipers.

28. The printer system of claim 24, wherein the means for wiping includes a plurality of arcuately arranged wipers and wherein the means for radially extending and retracting the means for wiping is configured to radially extend the plurality of arcuately arranged wipers in unison with one another to print head servicing positions in which all of the plurality of wipers are concurrently positioned to apply force to one or more of the plurality of print heads without further movement of the wipers.

29. A method comprising:

moving a set of arcuately arranged print heads into position;

extending a plurality of wipers radially towards said set of print heads, wherein the print heads are arcuately arranged about an axis; and movingly the set of arcuately arranged print heads in a direction along the axis across the wipers as the wipers apply force to the print heads.

30. The method of claim 29, and further comprising spooling a web material between said print heads and the extended wipers.

31. The method of claim 29, wherein the plurality of wipers are arcuately arranged about the axis and wherein the extending of the plurality of wipers radially towards the set of print heads includes concurrently moving the plurality of wipers in unison with one another to print head servicing positions in which all of the first plurality of wipers are concurrently positioned to apply force to one or more of the set of print heads without further movement of the wipers.

32. The method of claim 29, wherein the plurality of wipers are arcuately arranged about the axis.

33. An apparatus, comprising:

wipers arranged in an arcuate configuration;

a wiper mechanism to move said wipers radially; and print heads configured to be moved in a direction along an axis of the arcuate configuration across the wipers during wiping of the print heads.

* * * * *

UNITED STATES PATENT AND TRADEMARK OFFICE

CERTIFICATE OF CORRECTION

PATENT NO. : 7,540,583 B2
APPLICATION NO. : 11/082093
DATED : June 2, 2009
INVENTOR(S) : John A. Barinaga et al.

It is certified that error appears in the above-identified patent and that said Letters Patent is hereby corrected as shown below:

In column 8, line 6, in Claim 27, after "a plurality of" insert -- arcuately --.

Signed and Sealed this

Sixth Day of April, 2010

David J. Kappos

David J. Kappos
*Director of the United States Patent and Trademark Office*